United States Patent [19]

Tanino

[11] Patent Number: 4,858,727

[45] Date of Patent: Aug. 22, 1989

[54] APPARATUS AND METHOD FOR TRANSMITTING SIGNAL FOR ELEVATOR

[75] Inventor: Junichi Tanino, Inazawa, Japan

[73] Assignee: Mitsubishi Denki Kabushiki Kaisha, Japan

[21] Appl. No.: 216,209

[22] Filed: Jul. 6, 1988

[30] Foreign Application Priority Data

Jul. 6, 1987 [JP] Japan ..... 62-168138

[51] Int. Cl.[4] ..... B66B 3/00

[52] U.S. Cl. ..... 187/121

[58] Field of Search ..... 187/121, 130; 370/85, 370/86

[56] References Cited

U.S. PATENT DOCUMENTS

| | | | |
|---|---|---|---|
| 4,376,930 | 3/1983 | Sasao | 187/121 |
| 4,497,391 | 2/1985 | Mendelsohn et al. | 187/121 |
| 4,600,087 | 5/1985 | Tsuji et al. | 187/29 |
| 4,639,912 | 1/1987 | Tanino | 370/86 |
| 4,683,989 | 8/1987 | Pillage et al. | 187/121 |

FOREIGN PATENT DOCUMENTS

| | | |
|---|---|---|
| 58-69685 | 4/1983 | Japan . |
| 59-198274 | 11/1984 | Japan . |
| 60-157478 | 8/1985 | Japan . |
| 60-197573 | 10/1985 | Japan . |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A controller for registering a hall calling is connected to signal transmitter/receiver units in halls by way of one signal wiring, a first instruction for detecting whether there is a hall calling in zones set at a plurality of sets and contained with predetermined number of hall buttons or not is outputted from the controller, a signal transmitter/receiver outputs, when the first instruction is inputted thereto, zone data indicating the presence or absence of a calling signal in the zone, a second instruction for detecting the floor having the calling signal is outputted, when the zone data is inputted to the controller, from the controller only to the signal transmitter/receiver unit in the zone having the calling, the signal transmitter/receiver unit which receives the second instruction outputs floor data indicating which is the floor having the calling signal, and the controller which receives the data outputs a lamp ON signal of the calling registration lamp to the signal transmitter/receiver unit.

10 Claims, 7 Drawing Sheets

APPARATUS AND METHOD FOR TRANSMITTING SIGNAL FOR ELEVATOR

BACKGROUND OF THE INVENTION

The present invention relates to an apparatus and a method for transmitting a signal for an elevator.

FIGS. 6 to 8 are views showing a prior-art apparatus for transmitting a signal for an elevator disclosed, for example, in Japanese laid-open patent application No. 69685/1983. FIG. 6 is a block circuit diagram of the entire construction, FIG. 7 is a block circuit diagram of the essential portion, and FIG. 8 is an explanatory view of the operation of the prior-art apparatus.

In the drawings, reference numeral 1 denotes a controller which is installed in a machine room for an elevator, composed of a microcomputer (hereinafter referred to as "a MCOM") for generating a clock signal and a reference signal to be described later to register hall and cage callings, numeral 2 denotes a signal wiring group connecting to the controller 1 and having signal wirings 3, 4 and 5, numeral 3 denotes a signal wiring for transmitting clock signals 3*a* generated at a predetermined period (e.g., 50 microseconds), numeral 4 denotes a signal wiring for transmitting hall calling signal 4*a*, numeral 5 denotes a signal wiring for transmitting hall calling registration signal 5*a*, numerals 61 to 69 denote first to ninth floor hall buttons (the distinction of up and down callings is omitted), numerals 71 to 79 denote hall calling registration lamps for displaying similar hall calling registrations, numeral 81 to 89 denote memories connected to the signal wiring groups 2, the hall buttons 61 to 69 and the hall calling registration lamps 71 to 79 provided in first to ninth floors, numeral 91 denotes a signal wiring for connecting the controller 1 to the memory 81 to transmit a reference signal 91*a* becoming "H" only for one period (including a short time delay) of the clock signal 3*a*, numerals 92 to 99 denote signal wirings for respectively connecting among the memories 82 through 89 to transmit reference signals 92*a* to 99*a* sequentially becoming "H" only for one period (including a short time delay) of the clock signal 3*a* in a time delay (the signals 95*a* to 99*a* are omitted in the drawings), numerals 101 to 103, . . . and 111 to 113, . . . denote D flip-flops (hereinafter referred to as "memories"), and numerals 121 to 123, . . . denote AND gates.

The prior-art apparatus for transmitting a signal for an elevator is constructed as described above, since the output 92*a* of the terminal Q of the memory 101 becomes, when the clock signal 3*a* is applied to the signal wiring 3 and the reference signal 91*a* is applied to the signal wiring 91, the input 9*a* of a terminal D at the rising time of the input 3*a* of a terminal CL, the output 92*a* becomes "H" only for one period of the clock signal 3*a* when the reference signal 91*a* becomes "L". Similarly, the reference signals 92*a* to 94*a*, . . . sequentially become, as shown in FIG. 8, "H" in a time delay. Here, if the second floor hall button 62 is depressed, when the reference signal 93*a* becomes "H", the output of the AND gate 122 becomes "H", and it is transmitted on the signal wiring 4 to the controller 1 as the hall calling signal 4*a*. If the third floor hall button 63 is depressed, when the reference signal 94*a* becomes "H", the output of the AND gate 123 becomes "H", and it is transmitted on the signal wiring 4 as the hall calling signal 4*a*. This operation is sequentially repeated to obtain the states of the hall buttons 61 to 69. When the predetermined number of pulses are finished to be transmitted as the clock signals 3*a*, data are all collected. These signals are processed in the controller 1, and registered as the hall callings.

The hall calling registration signal 5*a* thus registered is transmitted by way of the signal wiring 5*a*, and the input of the terminal D of the memory 112 corresponding to the second floor hall becomes "H". At this time, since the reference signal 93*a* of the input of the terminal CL of the memory 112 is "H", the output of the terminal Q becomes "H", which is held. Thus, the second floor hall calling registration lamp 72 is turned ON to display the registration of the hall calling. In this manner, the signals corresponding to the floors are transmitted and received by way of the four signal wirings.

In the prior-art apparatus for transmitting the signals in the elevator as described above, the data of the hall buttons 61 to 69 are scanned. Thus, the transmitting time tends to become long. In other words, the number of the hall buttons is ordinarily $2n-2$ (n is the number of the floors). For example, in a superhigh storied building of sixty-four floors, the data of 126 hall buttons must be scanned. If a transmitting time necessary for one signal is 0.5 msec., the processing time necessary to transmit the hall button data becomes 63 msec. Accordingly, even if information except the hall button data, such as fire signals to arrival prenotice lamps installed in the respective halls for displaying the arrivals of the cages are intended to be transmitted on the same signal wiring, $2n-2$ of data are required for the arrival prenotice lamps, and, thus, further 63 msec. is necessary. If the transmissions of the fire signals of the hall calling registration lamps 71 to 79 are considered, the transmitting time is consumed 63 msec. $\times 3 = 189$ msec. In addition, position indicators and direction lamps which indicate the positions of the cages are installed in the halls. If the fire signals to be transmitted thereto are considered, the period of time from when the hall buttons 61 to 69 are depressed to when the hall calling registration lamps 71 to 79 are fired becomes long, and it is not practical. (If it is shorter than 0.1 sec., it is seen for human being to fire momentarily, but if it is longer than 0.1 sec., it is felt unnaturally delay by the human being.)

SUMMARY OF THE INVENTION

The present invention has been made to eliminate the above-described drawbacks and has for its object to provide an apparatus for transmitting a signal for an elevator in which signals can be processed at a shorter transmitting speed by less number of signal wirings, i.e., a number of signals can be processed at the same degree of transmitting speed as that of the prior-art apparatus.

An apparatus for transmitting signals for an elevator according to the present invention connects a controller for registering hall callings to signal transmitters/-receivers in the respective halls by way of signal wirings, and outputs a first instruction for detecting whether there is a hall calling or not in a zone having a predetermined number of hall calling buttons from the controller. The signal transmitter/receiver which inputs the first instruction output zone data indicating the presence or absence of the calling signal in the zone. When the zone data is inputted to the controller, the controller outputs a second instruction for detecting the floor having the calling signal to the signal transmitter/-receiver of the zone having the calling. The signal transmitter/receiver which inputs the second instruction outputs floor data indicating which of the floors has the calling signal. The controller which receives the floor data outputs the fire signal of the calling registration lamp to the signal transmitter/receiver.

In the present invention, it detects whether there is the calling signal in the zone, and processes the signal only for the zone having the calling signal. Accordingly, it can save the time of processing the signal for the zone having no calling signal. Further, these signal processes are executed by way of one signal wiring.

BRIEF DESCRIPTION OF THE DRAWINGS

In the drawings, the same symbols indicate identical or corresponding portions.

DESCRIPTION OF THE PREFERRED EMBODIMENTS

Figure 1:
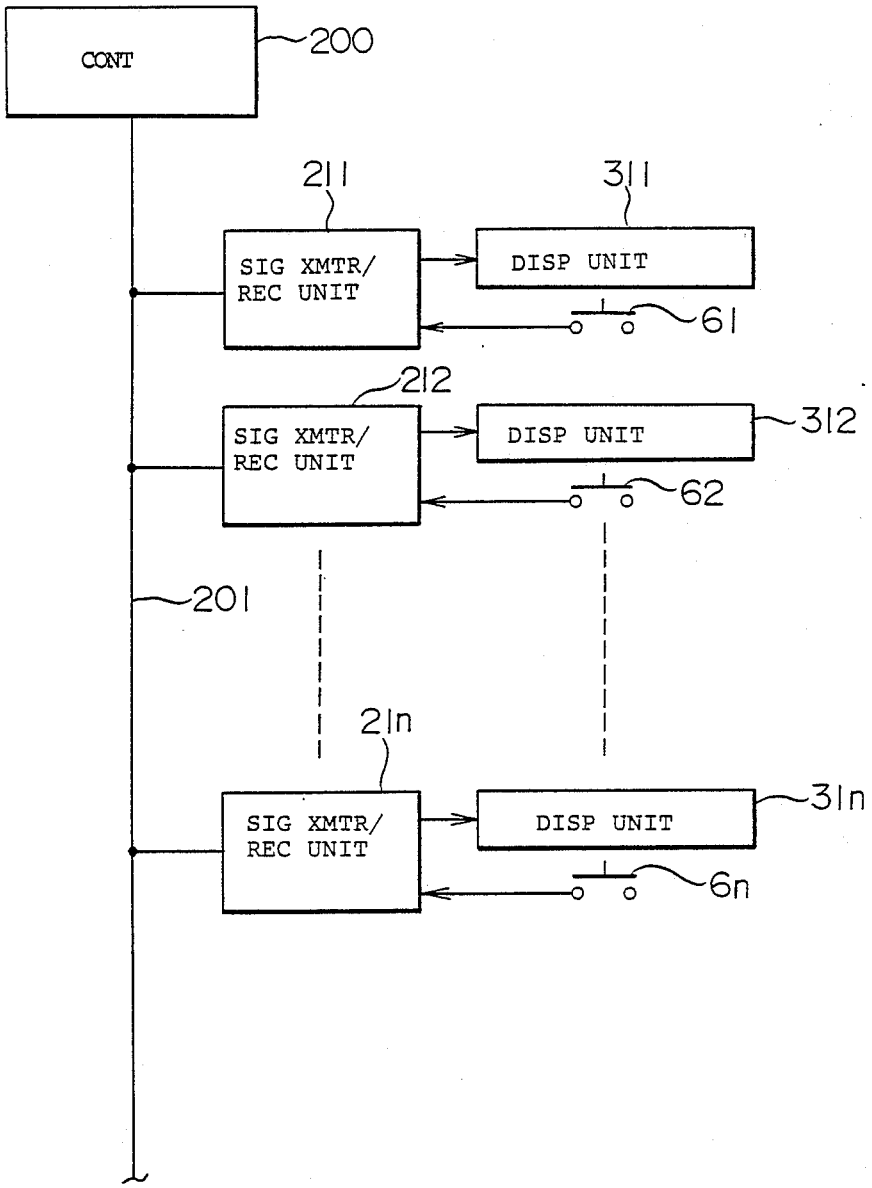
FIG. 1 is a block diagram of the entire construction of an embodiment of an apparatus for transmitting a signal for an elevator according to the present invention.
Figure 2:
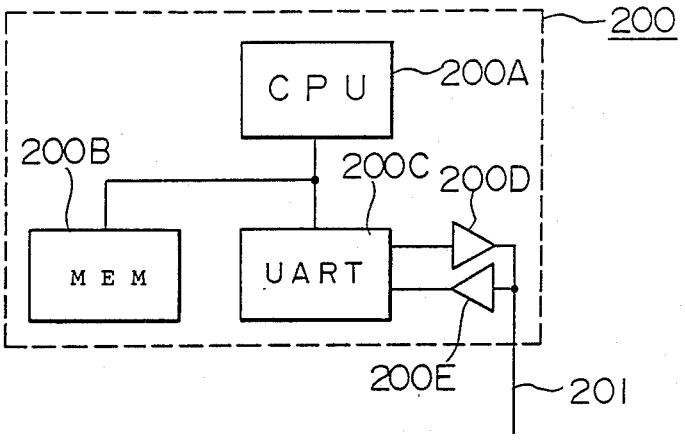
FIG. 2 is a block diagram of a controller of FIG. 1.
Figure 3:
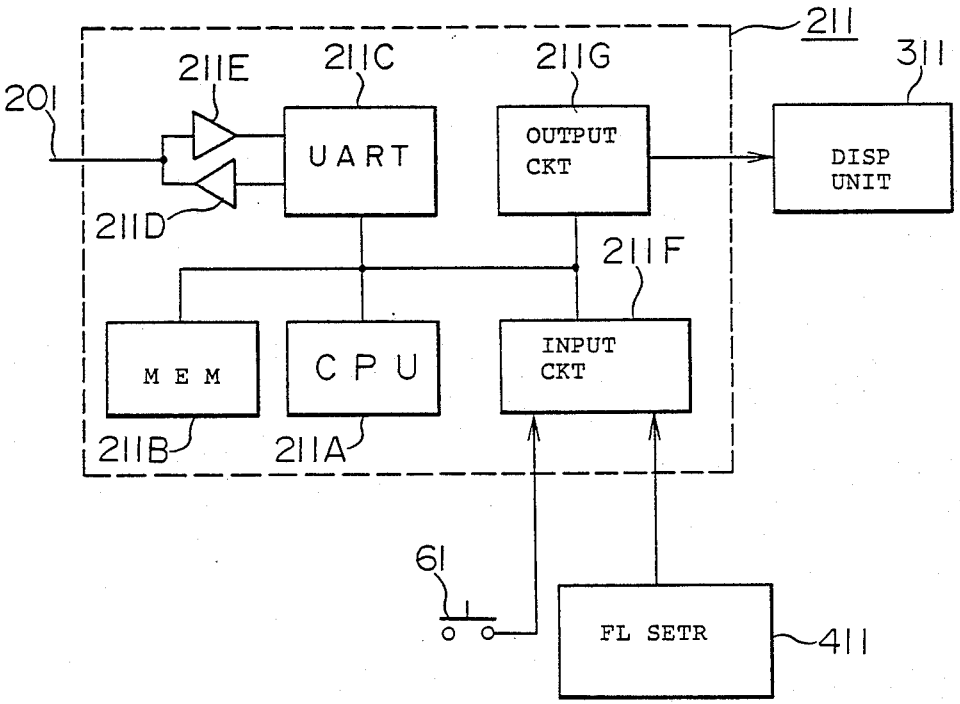
FIG. 3 is a block diagram of a signal transmitter/-receiver of FIG. 1.
Figure 4:
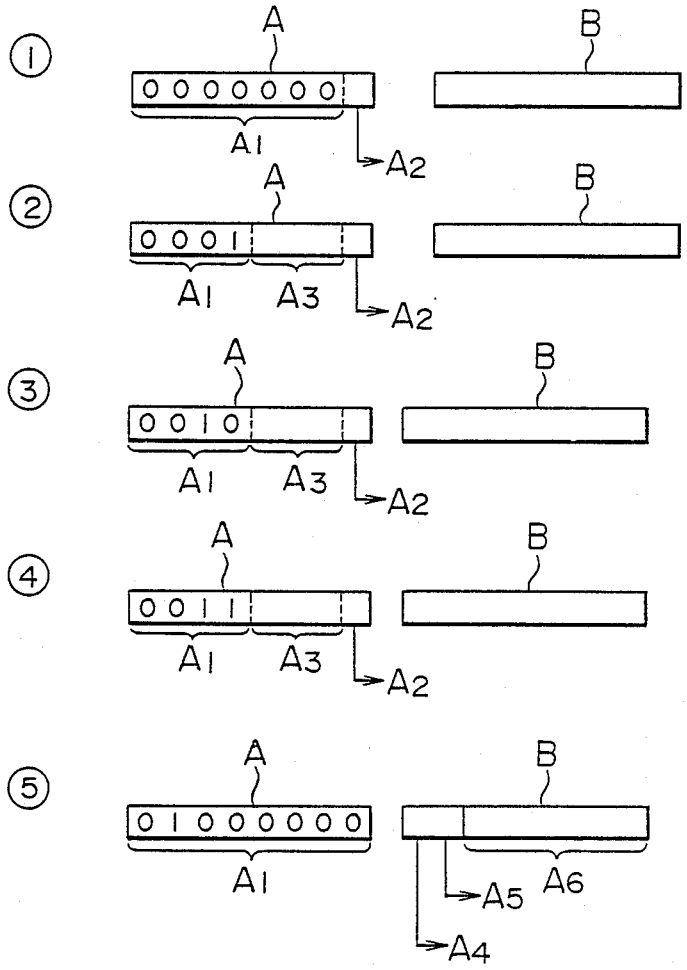
FIG. 4 is a view of the contents of the signal.
Figure 5:
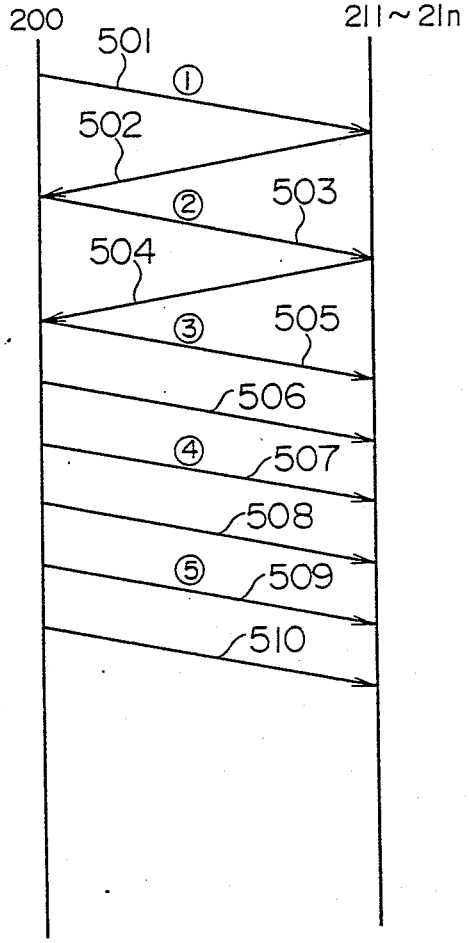
FIG. 5 is a view for explaining the transmission.
Figure 6:
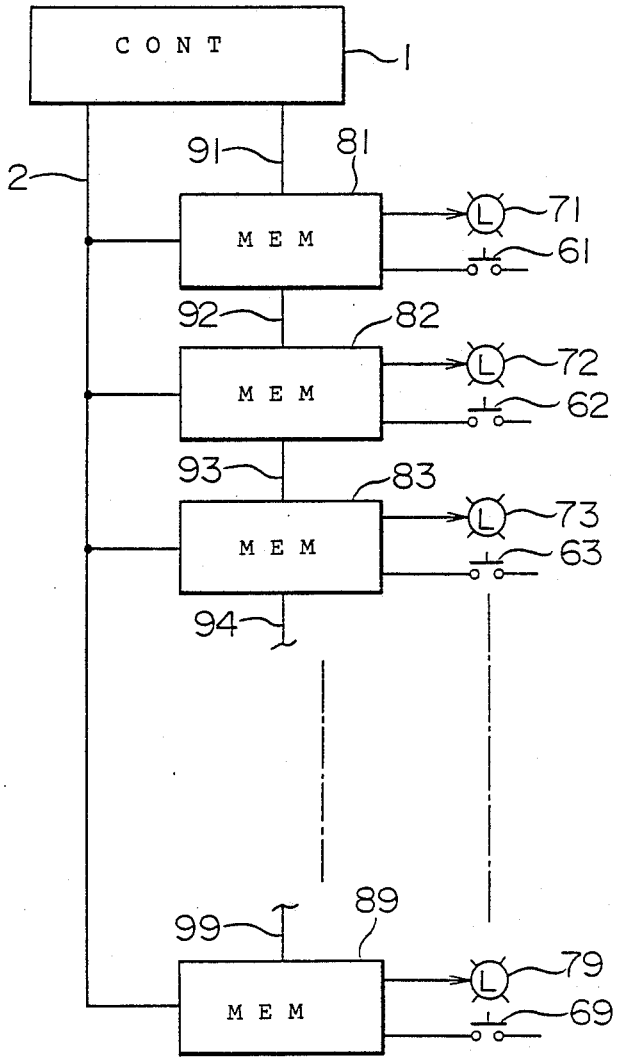
FIG. 6 PRIOR ART
FIG. 6 is a view of the entire construction of a prior-art apparatus for transmitting a signal for an elevator.
Figure 7:
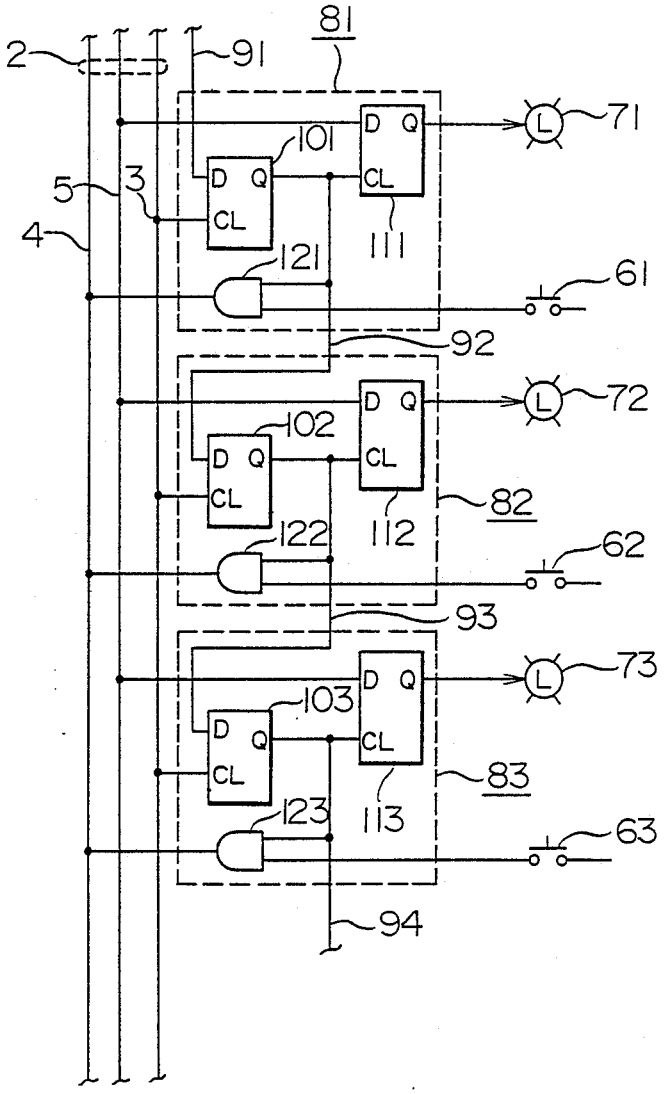
FIG. 7 PRIOR ART
FIG. 7 is a block circuit diagram of the essential portion of FIG. 6.
Figure 8:
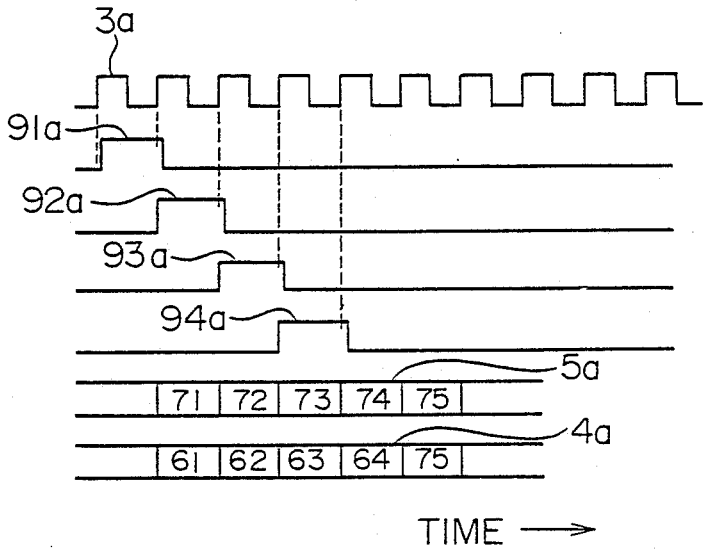
FIG. 8 is a view for explaining the operation.

FIGS. 1 to 5 are views showing an embodiment of the present invention. FIG. 1 is a view of the entire construction, FIG. 2 is a block diagram of a controller, FIG. 3 is a block diagram of a signal transmitter/-receiver, FIG. 4 is a view of the contents of the signal, and FIG. 5 is a view for explaining the transmission.

This embodiment comprises, as apparent from FIG. 1, a controller 200 installed in a machine room, signal transmitter/receiver units 211 to **21*n* installed in the respective halls and one signal wiring 201 for connecting them. Hall buttons 61 to 6*n*, and display units 311 to 31*n*, such as hall calling registration lamps, arrival prenotice lamps and position display lamps are connected to the signal transmitter/receiver units 211 to 21*n***.

The controller 200 is composed of MCOM, and has a CPU 200A, a memory 200B, a parallel-to-series converter 200C called "UART", a driver 200D which outputs an output signal from the UART 200C to the signal wiring 201 and a receiver 200E which inputs data from the signal wiring 201 to the UART 200C. The signal transmitter/receiver unit 211 (similarly to the other signal transmitter/receiver units) is composed of the MCOM, and has a CPU 211A, a memory 211B, an UART 211C; a driver 211D, a receiver 211D, an input circuit 211F and an output circuit 211G respectively connected to the signal wiring 201. A floor setter 411 which inputs switch data for setting the addresses of the hall button 61 and the signal transmitter/receiver unit 211 is connected to the input circuit 211F, and a display unit 311 is connected to the output circuit 211G.

In the apparatus for transmitting the signal for the elevator constructed as described above, the signals as shown in FIG. 4 are transmitted and received by way of the signal wiring 201 in a time division manner as shown in FIG. 5.

Instructions (1) to (5) in FIG. 4 respectively have first byte A and second byte B, which byte each has 8 bits.

The numeral (1) denotes the first instruction. The first byte A are data for detecting whether the hall buttons 61 to **6*n* of the zones (the zones divided by the total number of the hall buttons 61 to 6*n*, and one zone includes 8 hall buttons) are depressed or not, consisting of a 7-bit command $A_1$ and direction data $A_2$ indicating 1-bit up or down button. The second byte B is data becoming "0" when there is the floor where any of the hall buttons 61 to 6*n*** is depressed in the zone, and divided to 0, 1 to 7 bits.

The numeral (2) denotes the second instruction, consisting of 4-bit command $A_1$ for receiving data indicating where the hall calling generated in each zone is disposed in the zone, 3-bit zone data $A_3$ and 1-bit direction data $A_2$. The second byte B is input data.

The numeral (3) denotes output instructions when any of the hall buttons 61 to **6*n*** is depressed. The first byte A has 4-bit command $A_1$, 3-bit zone data $A_3$ and 1-bit direction data $A_2$. The second byte B is data which indicates ON ("0") or OFF ("1") of 8 hall calling registration lamps in the zone.

The numeral (4) denotes output instructions for arrival prenotice lamp in the halls. The first byte A has 4-bit command $A_1$, 3-bit zone data $A_3$ and 1-bit direction data $A_2$. The second byte B is data indicating ON ("0") or OFF ("1") of 8 arrival prenotice lamps in the zone.

The numeral (5) denotes output instructions for position display lamps in the halls. The first byte A has 8-bit command $A_1$. The second byte B has 2-bit upward data $A_4$, downward data $A_5$ and 6-bit cage position data $A_6$.

8 zones$\times$8, i.e., the data of 64 stories can be transmitted and received by assigning such instructions. The zones are divided in such a manner that the first to eighth floors are zero zone, the ninth to sixteenth floors are first zone, the seventeenth to twenty-fourth floors are second zone, twenty-fifth to thirty-second floors are third zone, thirty-third to fourth floors are fourth zone, forty-first to forty-eighth floors are fifth zone, forty-ninth to fifty-fourth floors are sixth zone, and fifty-fifth to sixty-fourth floors are seventh zone.

Then, the operation of the embodiment constructed as described above will be described with reference to FIG. 5.

Here, steps 501 and 503 indicate the procedure of the instructions, steps 502 and 504 indicate responding procedure, and steps 505 to 510 indicate outputting procedures.

In step 501, in order to input data regarding the operating states (the presence or absence of hall calling) of the hall buttons 61 to **6*n*, the controller 200 outputs the first instruction. The signal transmitter/receiver units 211 to 21*n* which receive the first instruction confirm the operating states of the hall buttons in the respective zones according to the floor data (the address set for the respective zones) set by the floor setter 411 in step 502**. If any of the hall buttons is depressed, the signal in the zone becomes "0". For example, when the up button in the tenth floor is depressed, only the first zone, i.e., the first bit of the second byte B becomes "0". When the buttons in both the fifth and tenth floors are simultaneously depressed, the zero and first zones, i.e., the 0-th and first bits of the second byte B become "0".

The content of the first instruction at this time is such that the instruction in which a response signal "0" is outputted only to the signal transmitter/receiver unit which detects the fact that there is the hall calling of the signal transmitter/receiver units having the address of the first zone and the response signal is not outputted to the signal transmitter/receiver units which do not detect the calling is outputted. Then, the same instruction is applied to the signal transmitter/receiver units of the respective zones, such as the second zone, the third zone, etc. The signal transmitter/receiver units of the respective zones output signals to the corresponding bits of the second bytes to collect the zone data finally as a whole by this operation.

In step 503, the controller 200 which receives the zone data as described above sets the address of the zone where the zone data becomes "0" in the portion of the zone data $A_3$ of the first byte of the second instruction to output it as a second instruction. For example, when the up button in the tenth floor is depressed, "0010" (3 bits from the left indicate the first zone, and the bit in the right end indicates the up button) indicating the first zone is set in the $A_3$ to output the content as a second instruction.

The signal transmitter/receiver units 211 to 21*n* which receive the signal only in the ninth to sixteenth floors operate and output the input data B where the 0th bit (ninth floor) is "1", the second bit (tenth floor) is "0", the third bit (eleventh floor) is "1", . . . , the seventh bit (sixteenth floor) is "1" in step 504. If the hall buttons 61 to 6*n* in two or more zones are depressed, the second instructions (2) of the step 503 are sequentially outputted to obtain the hall button data of the respective floors. The controller 200 detects that the hall button data obtained by the second instruction (2) can be registered, and outputs the first byte A of the output instruction (3) with the similar zone of the second instruction (2) and the distinction of the up or down button in step 505. Further, in step 506, the controller 200 further outputs the second byte B by adding the filing data of the hall calling registration lamp thereto. In other words, the first bite A of the instruction for firing the tenth up registration lamp is "00100010", and the second byte B is "10111111".

The signal transmitter/receiver units 211 to 21*n* which receive the output instruction (3) fire the tenth up registration lamp, and resets the tenth up button signal to prevent the up button signal from being again transmitted to the controller 200 at the next scanning time. This prevention is released when the lamp OFF command outputted from the controller 200 after the elevator arrives at the floor is received.

The output instruction (4) is for turning ON and OFF the arrival prenotice lamp, and transmitted only when the cage position is altered by the output instruction (5) continued to the processes of the hall buttons 61 to 6*n*, i.e., the floor to be displayed is altered. Accordingly, if the cage position is not varied, this output is not executed, and the hall buttons 61 to 6*n* are again scanned from step 501. If the cage position is moved to the arrival floor zone to fire the arrival prenotice lamp, the first byte A of the output instruction (4) is transmitted in step 507, and the second byte B is transmitted in step 508. For example, when the tenth floor up prenotice lamp is turned ON, the first byte A becomes "00110010", and the second byte B becomes "10111111". When it is turned OFF, the first byte A becomes "00110010", and the second byte B becomes "11111111".

The output instruction (5) is for turning ON and OFF the position display lamp. In this case, since the lamps in all the floors display the same, the first byte B becomes "01000000", and the up or down lamp data $A_4$ and $A_5$ and the cage data $A_6$ (binary signal) are outputted to the second byte B in steps 509 and 510.

When the data are transmitted and received in this multi-directional asynchronous transmissions, if the calling is generated simultaneously in all the floors, the transmission of one byte 12 bits (synchronization bits and check bits are added in addition to 8 bits) are required, and the total bits become as below.

| | | | |
|---|---|---|---|
| (1) × 2: | 2 bytes × 2 = | 12 bits × 2 × 2 = | 48 bits |
| (2) × 16: | 2 bytes × 16 = | 12 bits × 16 = | 192 bits |
| (3) × 16: | 2 bytes × 16 = | 12 bits × 16 = | 192 bits |
| | | Total: | 432 bits |

When the transmitting time of 1 bit is 0.5 msec., 0.5×432=216 msec., which is longer than that of the prior-art apparatus, but the probability that the hall buttons 61 to 6*n* are simultaneously depressed is low, and if once registered, retransmission is not necessary as long as the registration is released after the cage responds. Therefore, the process for the calling signal becomes as below for one hall button.

| | | |
|---|---|---|
| (1) | 2 bytes × 2 = | 4 bytes |
| (2) | 2 bytes × 1 = | 2 bytes |
| (3) | 2 bytes × 1 = | 2 bytes |
| | Total: | 8 bytes |

Thus, the number of the total bits becomes 12 bits×8=96 ; bits. Therefore, it can be registered at 0.5 msec.×96=48 msec.

Further, since the arrival prenotice lamp signal and the cage position signal are required for the transmission of the data only when the cage position is altered, the time required for running 3 m between the floors becomes 3 m/600 m/min=3 m/600 m/60 sec.=0.3 sec.=300 msec. even if the cage runs at the highest speed by considering the case that the present elevator of maximum speed runs 3 m between the reference floors at 600 m/min. On the other hand, the time required for transmitting the data (two bytes necessary) at once becomes 0.5 msec.×2 bytes×12 bits=12 msec., and 96% of the time required for running between one floor can be available for the process of the callings. Further, even if the control of the arrival prenotice lamps is added, the decision of the floor landing is executed each for one floor. Thus, it is presumed to be processed in synchronization with the variation of the position display lamp even in the worst case. It becomes the processing time rate of 12 msec./300 msec by the elevator of the maximum speed in the same manner as described above. Therefore, most time can be exclusively available for the control of the callings.

Since the command $A_1$ shown in FIG. 4 still has vacant codes, other switches to be added to the hall, such as an operation pause switch, a display unit, such as a signal of a destination display lamp disposed in the main floor, can be transmitted on the same signal wiring 201, not necessary to add new wirings.

According to the present invention as described above, a plurality of zones which contain a predetermined number of calling buttons are set, the first instruction for detecting whether there is a hall calling or not in the zones is outputted from the controller. When the first instruction is inputted to the signal transmitter/receiver units, it outputs the zone data having the calling signal. When the zone data are inputted to the controller, the controller outputs the second instruction for detecting the floor having the calling signal in the zone. When the second instruction is inputted to the signal transmitter/receiver unit, it outputs the floor data having the calling signal, and the controller outputs the calling registration lamp and other display lamp ON signals. Therefore, the signals can be processed at a short transmitting speed by way of less number of signal wirings. In other words, a number of signals can be processed at the same degree of transmitting speed as that of the prior-art apparatus.

What is claimed is:

1. An apparatus for transmitting a signal for an elevator having a controller for controlling the registration of hall callings in a plurality of halls and the ON of registration lamps thereof, signal transmitter/receiver units provided in the respective halls and connected to said controller by way of a signal wiring, said signal transmitter/receiver units connected to a plurality of hall buttons for generating calling signals and said calling registration lamps operated by the lamp ON signal from said controller to transmit or receive signals from said controller to said signal transmitter/receiver units through said signal wiring comprising:

instruction means provided in said controller for outputting a first instruction for detecting whether said hall calling is generated in zones set in a predetermined number as divided by sets from said hall buttons by way of said signal wiring and outputting a second instruction for detecting the floor having said calling signal in the zone by way of said signal wiring when zone data generated in response to said first instruction and indicating the presence or absence of the hall calling in the zone, and responding means provided in said signal transmitter/receiver units for generating the zone data indicating whether there is a floor where said calling signal is generated in the zone or not to output it by way of said signal wiring when said first instruction is inputted thereto and generating hall data indicating the floor where said calling signal is generated to output it by way of said signal wiring when said second instruction is inputted thereto.

2. An apparatus for transmitting a signal for an elevator according to claim 1, further comprising output means inputting said hall data for outputting a lamp ON signal for firing said calling registration lamp of the floor having said calling according to the hall data, wherein said output means is provided in said controller to transmit said lamp ON signal to said signal transmitter/receiver unit by way of said signal wiring, and said signal transmitter/receiver unit fires said registration lamp in response to said lamp ON signal.

3. An apparatus for transmitting a signal for an elevator according to claim 2, wherein said responding means stops the output of said hall data when said lamp ON signal is transmitted from said output means thereto.

4. An apparatus for transmitting a signal for an elevator according to claim 3, wherein said responding means eliminates the output stopping state of said hall data in response to the output of a lamp OFF signal for said registration lamp by way of said signal wiring from said controller.

5. An apparatus for transmitting a signal for an elevator according to claim 1, further comprising detecting means for detecting the fact that the floor where a cage is disposed is varied, and display means for displaying the cage position, wherein said controller transmits a command signal for displaying on said display means by way of said signal wiring in response to the cage position variation signal outputting operation of said detecting means.

6. An apparatus for transmitting a signal for an elevator according to claim 1, further comprising arrival detecting means for detecting the fact that the cage arrives at the arrival zone of the floor to be stopped at, and prenotice means for prenotifying the arrival, of the cage, wherein said controller transmits a command signal for prenotifying to said prenotice means by way of said signal wiring in response to the detection signal outputting operation of said arrival detecting means.

7. An apparatus for transmitting a signal for an elevator according to claim 1, wherein said signal transmitter/receiver comprises floor setting means for setting codes indicating the zones belonging with the halls and setting codes indicating the number of the floors disposed in the halls, wherein said instruction means and said responding means transmit and receive the signal with the code set by said floor setting means as a reference.

8. An apparatus for transmitting a signal for an elevator according to claim 1, wherein said signal wiring is one, said controller and said signal transmitter/receiver units are connected to said signal wiring to transmit or receive the signal therebetween.

9. An apparatus for transmitting a signal for an elevator having a controller for controlling the registration of hall callings in a plurality of halls and the ON of registration lamps thereof, signal transmitter/receiver units provided in the respective halls and connected to said controller by way of a signal wiring, said signal transmitter/receiver units connected to a plurality of hall buttons for generating calling signals and said calling registration lamps operated by the lamp ON signal from said controller to transmit or receive signals from said controller to said signal transmitter/receiver units through said signal wiring comprising:

first instruction outputting means provided in said controller for outputting a first instruction for detecting whether said hall calling is generated in zones set in a predetermined number as divided by sets from said hall buttons by way of said signal wiring, zone data outputting means connected by way of said signal wiring to said first instruction outputting means for generating zone data indicating whether there is the floor where said calling signal is generated in the zone or not at every zone to output the same, second instruction outputting means connected to said zone data outputting means by way of said signal wiring for outputting a second instruction for detecting the floor having said calling signal in the zone to the zone having the hall calling when the zone data is received thereby, and hall data outputting means connected to said second instruction outputting means by way of said signal wiring for generating hall data indicating the floor where said calling signal is generated when said second instruction is inputted thereto to output the same.

10. A method for transmitting a signal for an elevator having a controller for controlling the registration of hall callings in a plurality of halls and the ON of registration lamps thereof, signal transmitter/receiver units provided in the respective halls and connected to said controller by way of a signal wiring, said signal transmitter/receiver units connected to a plurality of hall buttons for generating calling signals and said calling registration lamps operated by the lamp ON signal from said controller to transmit or receive signals from said controller to said signal transmitter/receiver units through said signal wiring comprising:

first step of dividing said hall buttons into a predetermined number of sets to determine the intrinsic zone for each set, second step of outputting a first instruction for detecting whether said hall calling is generated in said each zone or not from said controller to said signal transmitter/receiver unit in each zone, third step of outputting zone data indicating the presence or absence of the hall calling in each zone from said signal transmitter/receiver unit to said controller in each zone in response to said first instruction, fourth step of outputting from said controlled a second instruction for detecting the floor having the hall calling to said signal transmitter/receiver unit contained in the zone to which the zone data indicating the presence of said hall calling is outputted, fifth step of outputting the floor data indicating the floor having said hall calling to said controller from said signal transmitter/receiver unit receiving said second instruction, sixth step of outputting a lamp ON signal for turning ON the calling registration lamp of the hall having the hall calling from said controller to said signal transmitter/receiver unit according to the floor data, and seventh step of firing said calling registration lamp of the hall having the hall calling by said signal transmitter/receiver unit in response to said lamp ON signal.

* * * * *